US008629780B2

(12) United States Patent
Goulet et al.

(10) Patent No.: US 8,629,780 B2
(45) Date of Patent: Jan. 14, 2014

(54) METHOD OF DETECTING AND LOCALIZING A FIRE BASED ON A TIME DIFFERENCE AND AIR SPEEDS OF MONITORED AIR IN PIPE CONDUITS

(75) Inventors: Thomas Goulet, Unterägeri (CH); Peter Stahl, Zürich (CH)

(73) Assignee: Siemens Aktiengesellschaft, Munich (DE)

( * ) Notice: Subject to any disclaimer, the term of this patent is extended or adjusted under 35 U.S.C. 154(b) by 647 days.

(21) Appl. No.: 12/600,286

(22) PCT Filed: May 9, 2008

(86) PCT No.: PCT/EP2008/055726

§ 371 (c)(1), (2), (4) Date: Feb. 7, 2011

(87) PCT Pub. No.: WO2008/138877

PCT Pub. Date: Nov. 20, 2008

(65) Prior Publication Data

US 2012/0319853 A1 Dec. 20, 2012

(30) Foreign Application Priority Data

May 16, 2007 (EP) ..... 07108317

(51) Int. Cl.
*G08B 21/00* (2006.01)

(52) U.S. Cl.
USPC ..... 340/632; 340/628; 340/584; 73/31.02; 73/863.23

(58) Field of Classification Search
USPC ..... 340/584, 628, 632; 73/31.02, 863.02, 73/864
See application file for complete search history.

(56) References Cited

U.S. PATENT DOCUMENTS 5,708,218 A 1/1998 Jax

FOREIGN PATENT DOCUMENTS

EP 0692706 A2 1/1996
EP 1811478 A1 7/2007

*Primary Examiner* — Jeffery Hofsass
(74) *Attorney, Agent, or Firm* — Laurence A. Greenberg; Werner H. Stemer; Ralph E. Locher

(57) ABSTRACT

A method, a fire alarm, and a fire alarm system enable detection and localization of a fire in monitored rooms, having two detector units for detecting a fire parameter, wherein an evaluation unit connected to both detector units is used for evaluation. According to the invention, the air in the monitored rooms is fed to the first detector unit via a first pipe conduit and to the second detector unit via a second pipe conduit. Both pipe conduits are arranged in each monitored room and provided with suction intakes. The air is supplied to both detectors by means of at least one suction unit, and the air speed in each pipe conduit is different. If at least one threshold value is detected, a time difference between the detection of the threshold value at the first detector unit and the detection of the same threshold value at the second detector unit is determined by the evaluation unit and, using the determined time difference, the location of the fire is determined according to the air speed in the first pipe conduit and the second pipe conduits.

18 Claims, 4 Drawing Sheets

METHOD OF DETECTING AND LOCALIZING A FIRE BASED ON A TIME DIFFERENCE AND AIR SPEEDS OF MONITORED AIR IN PIPE CONDUITS

BACKGROUND OF THE INVENTION

Field of the Invention

The invention relates to a method, a fire alarm and a fire alarm system for detecting and localizing a fire in at least one monitored room.

Detection units, such as for example optical fire alarms, gas alarms, etc., are used to identify a characteristic fire value. One particular type of such fire detectors is what are known as aspirated smoke detectors. Such fire detectors are supplied with at least some of the air from a room or device by a suction pipe system by means of a suction apparatus such as a ventilator or fan for example and aspirate air samples continuously, analyzing their smoke content for example. The air is often aspirated from a number of suction points in the pipe system in this process. These points can be a number of meters away from one another and be assigned to different objects or spaces. If a characteristic fire value is identified by the detector unit connected to the pipe system, it is important that the location of the fire is determined as accurately as possible, so that measures to eliminate it can be instituted as quickly as possible.

Characteristic fire values are understood to be physical variables, which are subject to measurable changes in the environment of an incipient fire, for example the ambient temperature, the proportion of solids, liquids or gas in the ambient air or ambient radiation. In particular the formation of smoke particles or smoke aerosols or the formation of vapor or combustion gases is detected.

A method and apparatus for identifying and localizing a fire are known from the European patent EP 1634261 B1. On detection of a characteristic fire value the aspirated air present in the suction pipe system is blown out with a blower. This blower can be embodied as a ventilator or fan. After the aspirated air has been blown out, new air samples are aspirated from the monitored rooms. The location of the fire is then determined based on the time that passes before the characteristic fire value is detected once again.

WO 02/095703 A2 also describes a possibility for localizing and detecting a fire. Here too a detector unit is supplied with air from the monitored rooms via a suction pipe system. On detection of a characteristic fire value, subdetectors at the suction intakes are activated and used for localization.

BRIEF SUMMARY OF THE INVENTION

The object of the present invention should be seen as being to propose an efficient and cost-effective possibility for detecting and localizing a fire.

According to the invention the object is achieved respectively by the subject matter of the independent claims. Developments of the invention are set out in the subclaims.

It should been seen as a core of the invention that in order to detect and localize a fire in at least one monitored room, a first detector unit and a second detector unit are used to detect a characteristic fire value. The two detector units are connected to an evaluation unit for evaluating the detected characteristic fire value. According to the invention at least some of the air contained in the at least one monitored room is fed to the first detector unit via a first pipe conduit and to the second detector unit via a second pipe conduit. The first and second pipe conduits are arranged in each monitored room and provided with suction intakes. The room air is fed to both detector units by means of at least one suction unit, for example a ventilator, fan, etc. According to the invention the two pipe conduits are constituted such that the mean air speed of the supplied room air in the first pipe conduit is different from the mean air speed in the second pipe conduit. On detection of at least one parameter of the characteristic fire value, the evaluation unit determines at least one time difference between the detection of the at least one parameter or threshold value of the characteristic fire value of the first detector unit and the detection of the same at least one parameter of the second detector unit. The location of the fire is determined together with the at least one determined time difference as a function of the mean air speed in the first and second pipe conduits. The mean air speed is determined for example on the basis of a given suction speed of the at least one suction unit and the geometry of the pipe conduit, for example during commissioning of the detector units, during maintenance, on detection of a characteristic fire value, etc. and stored for example in the evaluation unit or determined there. The different air speeds between the first and second pipe conduits can be achieved here in that the pipe conduits have a different internal diameter at least in part. The internal diameter of the one pipe conduit can thus be different from that of the other pipe conduit over the entire length of the pipe conduit or just in one segment of the pipe conduit, for example by means of tapering, widening of a pipe segment, shutters, etc. Thus for example the first pipe conduit can have a smaller internal diameter than the second pipe conduit at least in part. According to the invention it is also possible for a pipe to be used, which has two separate flow paths of different internal diameter.

Suction holes are ideally positioned at the same places in both pipe conduits or pipe segments, so that the suction holes of the first and second pipe conduits are adjacent. Thus the two detector units and the suction intakes of the first and second pipe conduits are arranged in such a manner that the distances between the first detector unit and the suction intakes of the first pipe conduit are equal to the distances between the second detector unit and the suction intakes of the second pipe conduit. According to the invention the two pipe conduits can be passed parallel to one another. The suction intakes of the first pipe conduit can also have a different diameter from the suction intakes of the second pipe conduit. In principle any sort of detector for identifying a characteristic fire value can be used as the detector unit, in particular an optical detector, a gas alarm, etc. The two detectors here can be of the one same sort or type; for example two optical detector units or two gas alarm units are used. The two detector units can be integrated in a single fire alarm or can be separate units. According to the invention the first and second detector units have the same sensitivity. The at least some of the room air can be aspirated by a suction unit, such as a ventilator, fan, etc. and fed to the two detector units via the respective pipe conduits. It is however also possible for a specific suction unit to be used for each pipe conduit. It is thus also possible for example to vary the suction speed of the aspirated room air, so that the mean air speed is different in the two pipe conduits.

One advantage of the inventive method is that it is possible to localize the location of a fire in a very simple manner.

A further advantage is that the number of possible rooms to be monitored with only two detector units is very large compared with known methods. Far fewer detector units are thus required for a building, thereby allowing installation and maintenance to be significantly reduced.

The invention is described in more detail below with reference to an exemplary embodiment illustrated in a figure, in which:

DESCRIPTION OF THE INVENTION

Figure 1:
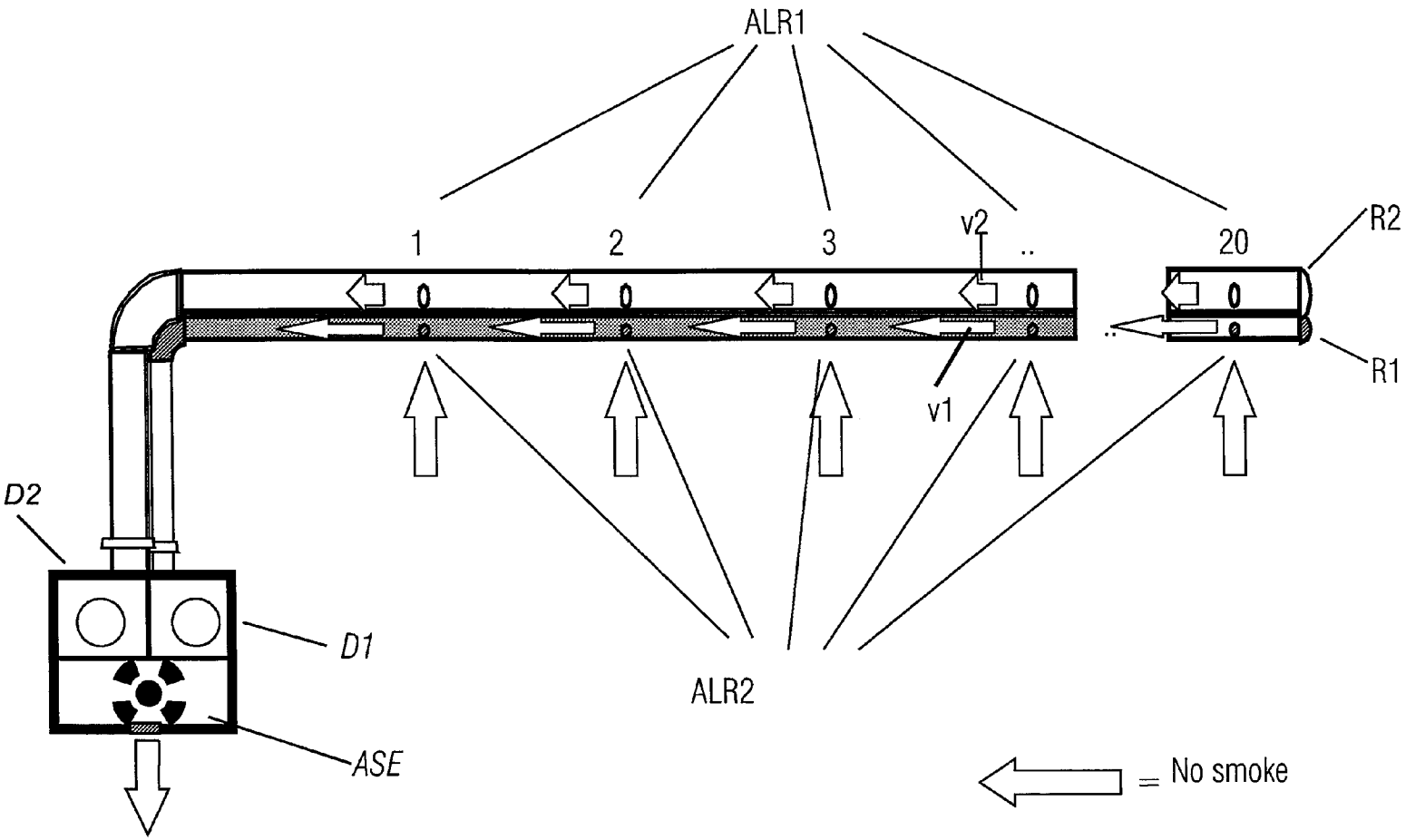
FIG. 1 shows an inventive fire alarm system in normal operation.

FIG. 1 shows an inventive fire alarm system in normal operation. Normal operation here means that there is no alarm state present. In this example the two detector units D1 and D2 are optical detector units and are integrated with the suction unit ASE in a housing. The evaluation unit AWE can of course also be contained in this housing. However the evaluation unit AWE can for example also be integrated in a central fire alarm system connected to both detector units. At least some of the air in the rooms to be monitored by the detector units D1, D2 is fed to the first detector unit D1 via a first pipe conduit R1 and to the second detector unit D2 via a second pipe conduit R2. The two pipe conduits R1, R2 are arranged in each monitored room and have suction holes ALR1, ALR2 for aspirating the room air from the monitored room. The suction intakes ALR1 or holes of the first pipe conduit R1 here can be of a different size or diameter from the suction intakes ALR2 of the second pipe conduit R2. The suction holes ALR1 of the first pipe conduit R1 are at the same distance from the first detector unit D1 as the suction holes ALR2 of the second pipe conduit R2 from the detector unit D2. They are therefore ideally arranged directly adjacent to one another. The two pipe conduits R1, R2 can be separate pipe conduits R1, R2 or can be integrated in one pipe. The two pipe conduits here essentially have separate flow paths; R1, R2 are therefore not connected to one another such that room air can flow from one pipe conduit R1 into the other pipe conduit R2. The same applies to the detector units D1 and D2. The first detector unit D1 is supplied exclusively with room air via the first pipe conduit R1 and the second detector unit D1 is supplied exclusively with room air via the second pipe conduit R2. The possible different geometries of the two pipe conduits R1, R2 produces a different mean air speed in the two pipe conduits. In this example the first pipe conduit R1 has a smaller cross-section or a smaller internal diameter than the second pipe conduit R2 and thus the mean air speed $v_1$ in the first pipe conduit R1 is greater than the mean air speed $v_2$ in the second pipe conduit R2 (see formula 1).

$$v_1 > v_2 \qquad \text{Formula 1:}$$

The different mean air speeds in the pipe conduits R1 and R2 are shown by the arrows of different sizes. For the suction unit ASE a ventilator or fan or another unit suitable for this purpose can be used to aspirate the room air. In this example only one suction unit ASE is used for both detector units D1, D2. Naturally it would also be possible according to the invention to use one suction unit ASE for each detector unit D1, D2. In particular such an arrangement could be used to generate a different air speed in the two pipe conduits R1, R2. This would also make it possible for the two pipe conduits R1, R2 to have the same internal diameter.

Figure 2:
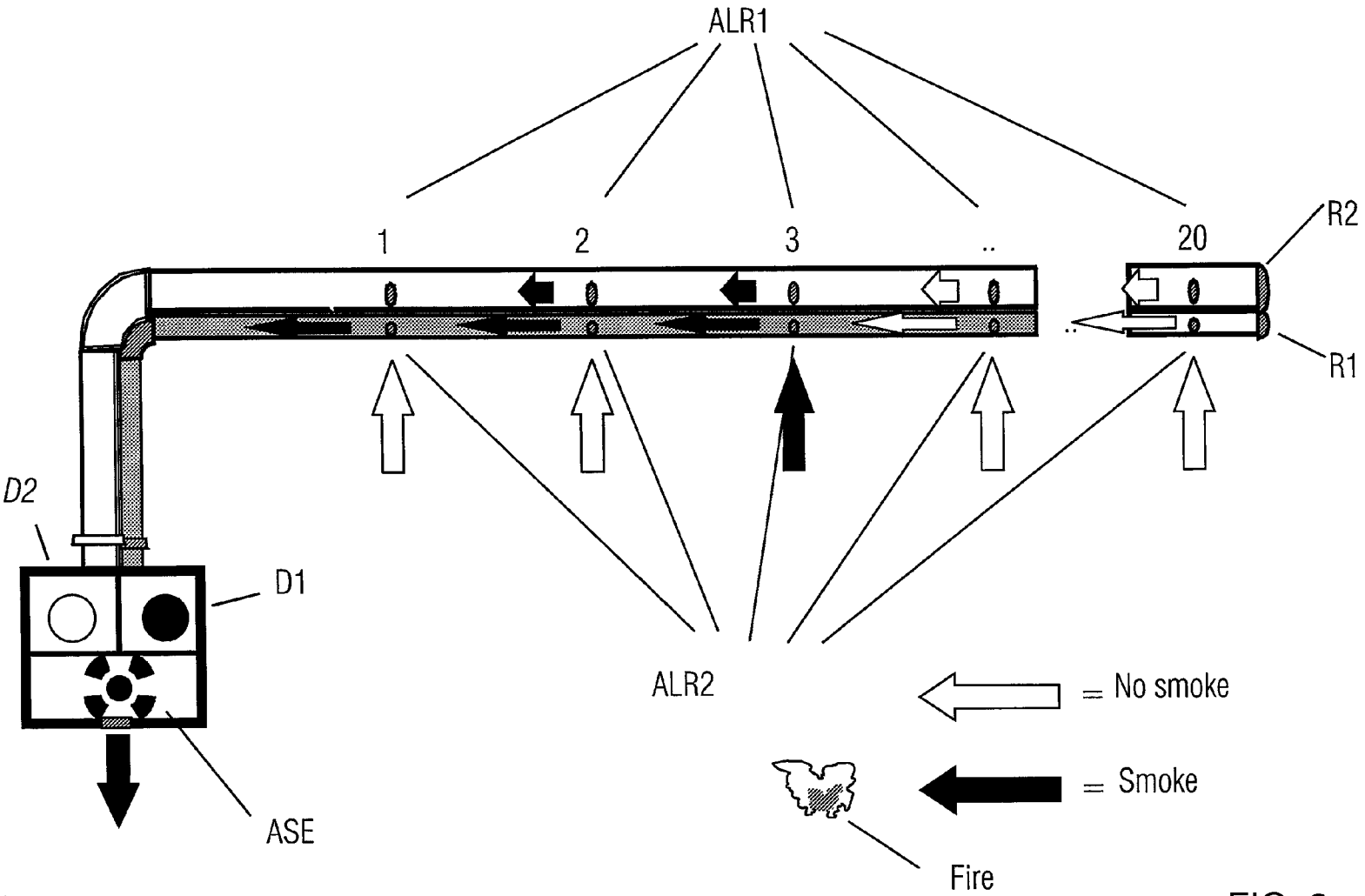
FIG. 2 shows an inventive fire alarm system during detection of a fire.

FIG. 2 shows an inventive fire alarm system, as described in FIG. 1, during the detection of a fire. Smoke from a monitored room is aspirated via the suction holes ALR1 "Number or room 3", ALR2 "Number or room 3" and fed via the two pipe conduits R1, R2 to the two detector units D1, D2. Because of the different geometries and therefore the different air speeds in the pipe conduits R1, R2, the first detector unit D1 detects the characteristic fire value and therefore the fire first. The first detector unit D1 outputs a corresponding alarm at time $t_1$, this being forwarded to a central fire alarm system for example.

Figure 3:
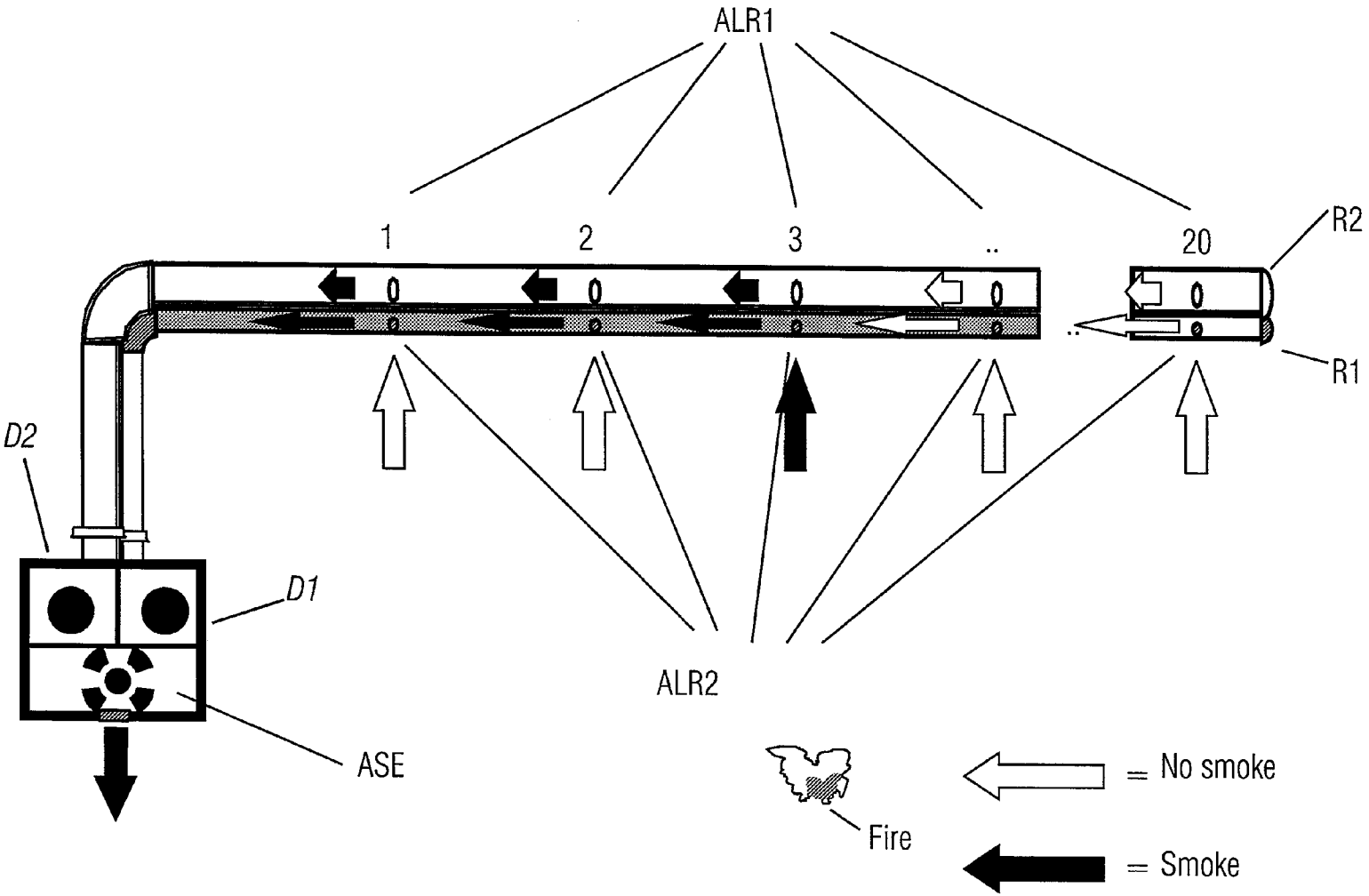
FIG. 3 shows an inventive fire alarm system during determination of the location of the fire and FIG. 4 shows an inventive fire alarm.

FIG. 3 shows the inventive fire alarm system described in FIGS. 1 and 2 and the determination of the location of the fire. At time $t_2$ the second detection unit D2 also detects the fire and likewise outputs an alarm. An evaluation unit AWE connected to both detector units determines the time difference between the first and second alarms (see formula 2).

$$\Delta t = t_2 - t_1 \qquad \text{Formula 2:}$$

The distance to the suction holes ALR1, ALR2, over which the room air containing smoke was aspirated, is then determined together with the two air speeds $v_2$ and $v_2$. The location of the fire is thus determined, in other words the room in which the fire is located. To increase the accuracy of the determination of the distance from the detector units to the relevant suction holes, it is also possible for the time differences relating to the detection of different successive parameters or threshold values of a characteristic fire value to be determined permanently. The first time difference is thus determined when threshold value 1 is reached, the second time difference when threshold value 2 is reached and so on. The air speeds can either be determined empirically from the physical variables, in other words for given pipe conduit geometries, suction hole diameters, suction speeds of the at least one suction unit, etc. or can be calculated or approximated numerically using the available physical variables. The air speeds $v_1$ and $v_2$ can therefore be considered to be mean air speeds. Ideally the distance d between the detector units D1, D2 and the suction holes ALR1, ALR2, over which the smoke was aspirated, can be determined by $$d = (v_1 - v_2) \cdot (t_2 - t_1) \qquad \text{Formula 3:}$$

Generally the distance d is defined by a function which is dependent on t1, t2, v1, v2 and it must be approximated correspondingly using mathematical methods.

Figure 4:
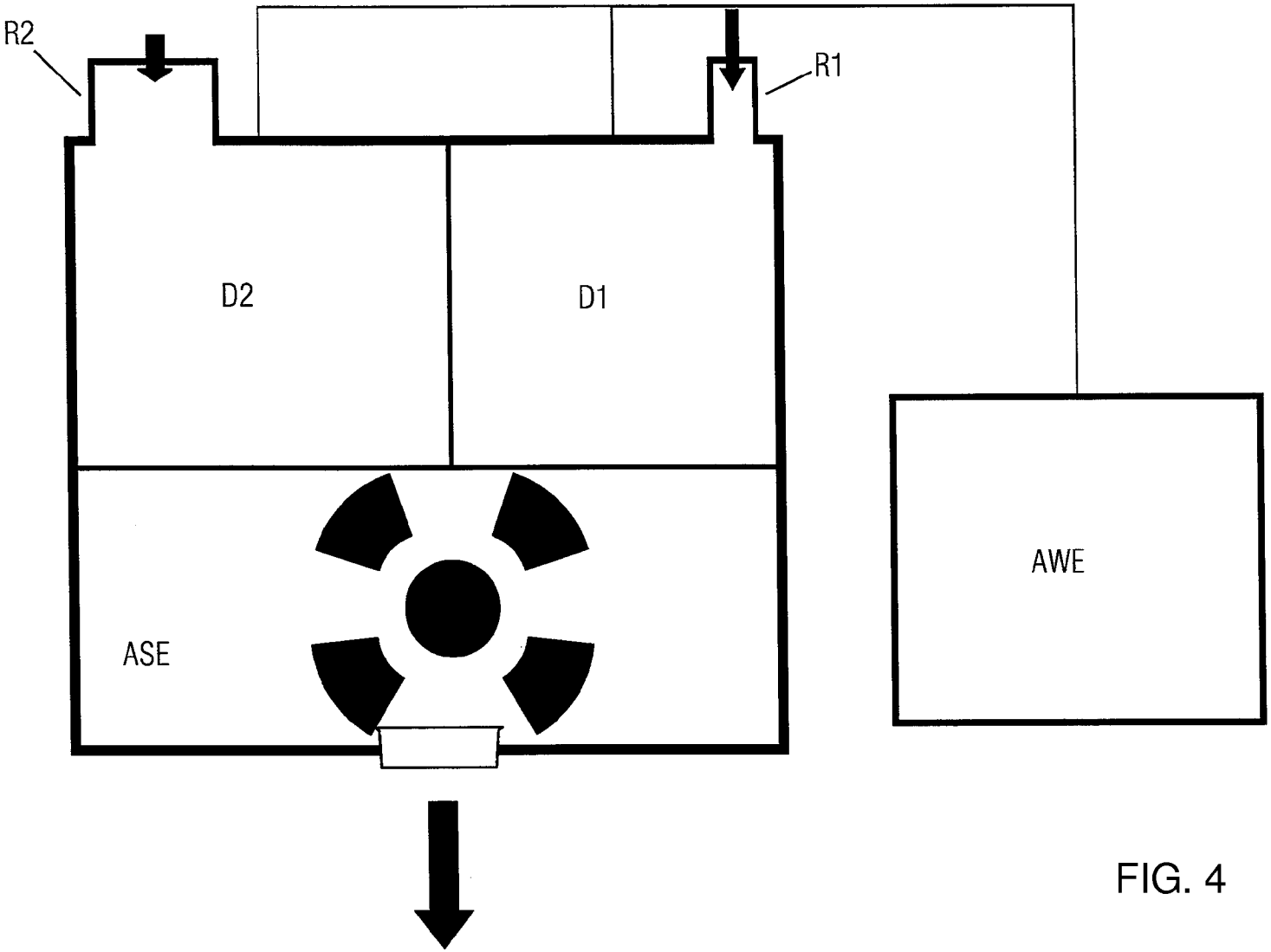

FIG. 4 shows an inventive fire alarm having a first detector unit D1, a second detector unit D2, a suction unit ASE and an evaluation unit AWE connected to both detector units to implement the method according to FIGS. 1 to 3. The first detector unit D1 is connected to a first pipe conduit R1 and the second detector unit D2 is connected to a second pipe conduit R2. The pipe conduits here are arranged in each monitored room and have suction holes ALR1, ALR2 to aspirate the room air from the room.

The invention claimed is:

1. A method for detecting and localizing a fire in a monitored room having a first detector unit and a second detector unit for detecting a characteristic fire value, and an evaluation unit connected to the first and second detector units and configured to evaluate the characteristic fire values, the method which comprises:

feeding at least some air contained in the monitored room to the first detector unit via a first pipe conduit and to the second detector unit via a second pipe conduit, the first and second pipe conduit being formed with suction intakes, thereby pumping the air to the detector units by way of at least one suction unit and setting a mean air speed of the air in the first pipe conduit to differ from a mean air speed in the second pipe conduit;

on detection of at least one threshold value of the characteristic fire value, determining with the evaluation unit a time difference between a detection of the at least one threshold value at the first detector unit and a detection of the same at least one threshold value at the second detector unit; and determining a location of the fire with the at least one determined time difference in dependence on the mean air speeds in the first and second pipe conduit.

2. The method according to claim 1, wherein the monitored room is a plurality of monitored rooms and the first and second pipe conduits have suction intakes formed in each of the monitored rooms.

3. The method according to claim 1, which comprises providing at least a portion of the first pipe conduit with a different internal diameter than the second pipe conduit.

4. The method according to claim 3, wherein the different internal diameter of the first pipe conduit is a smaller internal diameter than an internal diameter of the second pipe conduit.

5. The method according to claim 1, which comprises providing a pipe with two separate flow paths of mutually different internal diameters as the first and second pipe conduit.

6. The method according to claim 1, which comprises disposing the two detector units and the suction intakes of the first and second pipe conduits in such a manner that distances between the first detector unit and the suction intakes of the first pipe conduit are equal to the distances between the second detector unit and the suction intakes of the second pipe conduit.

7. The method according to claim 1, which comprises forming the suction intakes of the first pipe conduit with a different diameter than the suction intakes of the second pipe conduit.

8. The method according to claim 1, which comprises disposing the first and second pipe conduit parallel to one another.

9. The method according to claim 1, wherein the detector unit is either an optical detection unit or a gas alarm unit.

10. The method according to claim 9, which comprises using the same type of detector unit for the first and second detector units.

11. The method according to claim 1, wherein the first and second detector units are integrated in a fire alarm.

12. The method according to claim 1, wherein the first and second detector units are separate units.

13. The method according to claim 1, which comprises setting the first and second detector units to equal sensitivity.

14. The method according to claim 1, wherein the at least one suction unit is at least one of a ventilator and a fan.

15. The method according to claim 1, which comprises employing separate suction units for the first and second pipe conduits respectively.

16. The method according to claim 15, which comprises generating with the respective suction unit a different suction speed of the room air fed to the detector units in the first and second pipe conduits.

17. A fire alarm system for detecting and localizing a fire in a monitored room, comprising:

a first detector unit and a second detector unit for detecting a characteristic fire value;

a first pipe conduit formed with a suction intake for feeding air from the monitored room to said first detector unit and a second pipe conduit formed with a suction intake for feeding air from the monitored room to said second detector unit;

at least one suction unit for supplying the room air to said first and second detector units;

an evaluation unit connected to said first and second detector units for evaluating the characteristic fire value, on detection of a fire for determining at least one time difference between a detection of at least one threshold value of the characteristic fire value at said first detector unit and a detection of a same threshold value at said second detector unit and to determine a location of the fire from the at least one time difference thus determined and in dependence on respective air speeds in said first and second pipe conduits; and a central fire alarm system for outputting an alarm indicating a location of the fire.

18. A fire alarm for detecting and localizing a fire in at least one monitored room, comprising:

a first detector unit and a second detector unit for detecting a characteristic fire value, wherein at least some air contained in the at least one monitored room is fed to the first detector unit via a first pipe conduit and to the second detector unit via a second pipe conduit, the first and second pipe conduits being arranged in each monitored room and having suction intakes formed therein;

at least one suction unit for supplying the room air to said first and second detector units;

an evaluation unit connected to said first and second detector units to evaluate the characteristic fire value, on detection of a fire to determine at least one time difference between a detection of at least one threshold value of the characteristic fire value at said first detector unit and a detection of the same at least one threshold value at said second detector unit and to determine a location of the fire with the at least one determined time difference in dependence on respective air speeds in the first and second pipe conduits.

* * * * *